US008814334B2

(12) United States Patent
Shiono

(10) Patent No.: US 8,814,334 B2
(45) Date of Patent: Aug. 26, 2014

(54) LIQUID ACCOMMODATING CONTAINER AND LIQUID EJECTING APPARATUS

(71) Applicant: Sieko Epson Corporatio, Tokyo (JP)

(72) Inventor: Shohei Shiono, Matsumoto (JP)

(73) Assignee: Seiko Epson Corporation (JP)

( * ) Notice: Subject to any disclaimer, the term of this patent is extended or adjusted under 35 U.S.C. 154(b) by 0 days.

(21) Appl. No.: 13/745,967

(22) Filed: Jan. 21, 2013

(65) Prior Publication Data

US 2013/0187994 A1 Jul. 25, 2013

(30) Foreign Application Priority Data

Jan. 23, 2012 (JP) ..... 2012-010767
Jan. 23, 2012 (JP) ..... 2012-010768

(51) Int. Cl.
*B41J 2/175* (2006.01)

(52) U.S. Cl.
USPC ..... 347/86

(58) Field of Classification Search
USPC ..... 347/84–86
See application file for complete search history.

(56) References Cited

U.S. PATENT DOCUMENTS

| | | | | |
|---|---|---|---|---|
| 4,773,317 | A * | 9/1988 | Wickboldt, Jr. | 99/348 |
| 7,619,188 | B2 * | 11/2009 | Oghafua et al. | 219/620 |
| 7,883,193 | B2 | 2/2011 | Okito et al. | |
| 7,992,984 | B2 | 8/2011 | Toba et al. | |
| 8,070,272 | B2 | 12/2011 | Toba | |
| 8,262,005 | B2 * | 9/2012 | Garcia | 241/37.5 |
| 2012/0305549 | A1 * | 12/2012 | Wylie | 219/726 |

FOREIGN PATENT DOCUMENTS

| | | |
|---|---|---|
| JP | 2006-001240 | 1/2006 |
| JP | 2007-326360 | 12/2007 |
| JP | 2008-273040 | 11/2008 |
| JP | 2009-034889 | 2/2009 |

* cited by examiner

*Primary Examiner* — Kristal Feggins
(74) *Attorney, Agent, or Firm* — Harness, Dickey & Pierce, P.L.C.

(57) ABSTRACT

A liquid container (ink cartridge) is provided with a containing portion (ink pack) containing a liquid including dispersed particles and a solvent in which the dispersed particles are dispersed, and a stirring member contained in the containing portion, in which the stirring member has flexible portions covering a bottom surface of the containing portion.

22 Claims, 10 Drawing Sheets

LIQUID ACCOMMODATING CONTAINER AND LIQUID EJECTING APPARATUS

Priority is claimed under 35 U.S.C. §119 to Japanese Application Nos. 2012-010767 filed on Jan. 23, 2012 and 2012-010768 filed on Jan. 23, 2012, both of which are hereby incorporated by reference in their entirety.

BACKGROUND

1. Technical Field

The present invention relates to a liquid container and a liquid ejecting apparatus.

2. Related Art

In general, as inks used in ink jet recording apparatuses, ones in which dispersed particles of a pigment or the like are uniformly dispersed and mixed in a solvent are widely used. When such inks are left to stand for long periods, there is a tendency for the dispersed particles which have a heavy density in comparison with the solvent to precipitate. The precipitation of the dispersed particles leads to a decrease in recording quality, such as color unevenness or ink clogging in the recording apparatus, ejection defects or the like. Therefore, for example, in a case of a recording apparatus using an ink cartridge, in order to redisperse the precipitated dispersed particles in the inner portion of the ink cartridge, methods of shaking and stirring the ink cartridge have been adopted. However, in a sealed type ink cartridge which does not include an air layer in the inner portion, there are problems in that ink convection does not easily occur, and it is not possible to effectively perform stirring. In relation to this, various ink stirring methods and techniques providing a stirring mechanism have been proposed. For example, in JP-A-2006-1240, there is proposed a technique of performing stirring by inserting a stirring ball inside the ink cartridge.

However, the above-described technique of performing stirring by inserting a stirring ball inside the ink cartridge has a problem in that the volume of the stirring ball is great in comparison with the ink capacity and it is not possible to increase the filling rate of the ink. Specifically, in order to be able to effectively perform stirring in a short time by moving the stirring ball around every hole and corner even when the shaking frequency or the shaking width is small, there is a need to insert a sufficient number of stirring balls or to insert stirring balls having a sufficient size and weight. As a result, reducing the ratio of the volume occupied by the stirring ball in the ink cartridge is difficult, in particular, in a case where the ink cartridge is large, the volume occupied by the stirring ball, the weight, the necessary costs, and the like cannot be ignored.

SUMMARY

The invention can be realized in the following forms or application examples.

Application Example 1

The liquid container according to the Application Example is provided with a containing portion containing a liquid including dispersed particles and a solvent in which the dispersed particles are dispersed, and a stirring member contained in the containing portion, in which the stirring member has flexible portions covering a bottom surface of the containing portion.

According to the Application Example, the liquid container is provided with a stirring member having flexible portions covering the bottom surface of the containing portion. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

Accordingly, according to the Application Example, it is possible to provide a liquid container capable of more effectively stirring the dispersed particles by performing the rocking.

Application Example 2

In the liquid container according to the above-described Application Example, a density of a member configuring the stirring member is greater than a density of the solvent.

According to the Application Example, the liquid container is provided with a stirring member having flexible portions covering the bottom surface of the containing portion, in which the density of the member configuring the stirring member is greater than the density of the solvent. Accordingly, in a case where the liquid container is left to stand, the stirring member sinks in the solvent so as to cover the bottom surface. In a case where the sinking speed of the stirring member is fast in comparison with the precipitating speed of the dispersed particles, many of the dispersed particles being dispersed are precipitated so as to be deposited on the stirring member. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

More effective dispersion in the solvent is promoted for the dispersed particles, which are precipitated so as to be deposited on the stirring member, by the movement of the stirring member and, in particular, for the dispersed particles, which are precipitated so as to be deposited on the flexible portions, by the deformation of the flexible portions.

Accordingly, according to the Application Example, it is possible to provide a liquid container capable of more effectively stirring the dispersed particles by performing the rocking.

Application Example 3

In the liquid container according to the above-described Application Example, the stirring member has a flat plate shape.

According to the Application Example, the liquid container is provided with a stirring member having flexible portions covering the bottom surface of the containing portion. Since the stirring member has a flat plate shape, in a case where the liquid container is left to stand, the dispersed particles dispersed in the upper portion of the stirring member are precipitated so as to be deposited on the stirring member. The stirring member moves inside the liquid container when the liquid container is rocked and the flexible portion is deformed by the force received from the liquid and the containing portion. The convection of the liquid is promoted by the movement of the flat plate shaped stirring member and the deformation of the flexible portion and, in a case where the dispersed particles are precipitating, the dispersion in the solvent is promoted. In particular, the more effective dispersion in the solvent of dispersed particles, which are precipitated so as to be deposited on the stirring member, is promoted by the movement of the stirring member and the deformation of the flexible portions.

Accordingly, according to the Application Example, it is possible to provide a liquid container capable of more effectively stirring the dispersed particles by performing the rocking.

Application Example 4

In the liquid container according to the above-described Application Example, an area when the stirring member is seen in planar view is 50% or more of the area of the bottom surface of the containing portion.

According to the Application Example, the liquid container is provided with a stirring member having flexible portions covering the bottom surface of the containing portion. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

Since the area when the stirring member is seen in planar view is 50% or more of the area of the bottom surface of the containing portion, it is possible to promote the dispersion of the dispersed particles across a wider region of the dispersed particles precipitated on the bottom surface and a side surface of the containing portion.

Accordingly, according to the Application Example, it is possible to provide a liquid container capable of more effectively stirring the dispersed particles by performing the rocking.

Application Example 5

In the liquid container according to the above-described Application Example, the stirring member has a plurality of the flexible portions.

According to the Application Example, the liquid container is provided with a stirring member having a plurality of flexible portions covering the bottom surface of the containing portion. The stirring member moves inside the liquid container when the liquid container is rocked and the plurality of flexible portions are deformed by the force received from the liquid and the containing portion. The convection of the liquid is promoted by the movement of the stirring member and the deformation of the plurality of flexible portions and, in a case where the dispersed particles are precipitating, the dispersion in the solvent is promoted. Since there is the plurality of flexible portions promoting the convection of the liquid according to the deformation, it is possible to disperse the dispersed particles more effectively in the solvent.

Application Example 6

In the liquid container according to the above-described Application Example, an area when the flexible portion is seen in planar view is 70% or more of the area when the stirring member is seen in planar view.

According to the Application Example, the liquid container is provided with a stirring member having flexible portions covering the bottom surface of the containing portion. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

Since the area when the flexible portion is seen in planar view is 70% or more of the area when the stirring member is seen in planar view, the region in which the dispersion of the dispersed particles is promoted by the deformation of the flexible portion is widened and it is possible to promote the more effective dispersion of the dispersed particles across a wider region.

Accordingly, according to the Application Example, it is possible to provide a liquid container capable of more effectively stirring the dispersed particles by performing the rocking.

Application Example 7

In the liquid container according to the above-described Application Example, when the length of the flexible portion is set to a, the width is set to b, and the thickness is set to t, $b \leq 10$ mm.

According to the Application Example, the liquid container is provided with a stirring member having flexible portions covering the bottom surface of the containing portion. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

By the width b of the flexible portion being $\leq 10$ mm, the flexible portion is easily deformed by the force received from the liquid and the containing portion and the dispersed particles are more effectively dispersed by promoting the convection of the liquid.

Accordingly, according to the Application Example, it is possible to provide a liquid container capable of more effectively stirring the dispersed particles by performing the rocking.

Application Example 8

In the liquid container according to the above-described Application Example, when the length of the flexible portion is set to a, the width is set to b, and the thickness is set to t, $t \leq 0.3$ mm.

According to the Application Example, the liquid container is provided with a stirring member having flexible portions covering the bottom surface of the containing portion. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

By the thickness t of the flexible portion being $\leq 0.3$ mm, the flexible portion is easily deformed by the force received from the liquid and the containing portion and the dispersed particles are more effectively dispersed by promoting the convection of the liquid.

In addition, since it is possible to further reduce the volume that the stirring member occupies in the capacity of the liquid container, it is possible to provide a stirring member capable of effectively performing stirring without greatly decreasing the filling rate of the liquid.

Accordingly, according to the Application Example, it is possible to provide a liquid container capable of more effectively stirring the dispersed particles by performing the rocking.

Application Example 9

In the liquid container according to the above-described Application Example, the stirring member is further provided with a weight portion with a density of 1 g/cm$^3$ or more.

According to the Application Example, the liquid container is provided with a stirring member having flexible portions covering the bottom surface of the containing portion. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

Since the stirring member is further provided with a weight portion with a density of 1 g/cm$^3$ or more, in a case where the liquid container is rocked, the stirring member is more easily made to move in the solvent. As a result, the dispersed particles are more effectively dispersed by promoting the convection of the liquid. In addition, since the weight portion sinks easily, the stirring member can better fall into position according to the bottom surface without remaining on the side surface of the containing portion.

Accordingly, according to the Application Example, it is possible to provide a liquid container capable of more effectively stirring the dispersed particles by performing the rocking.

Application Example 10

In the liquid container according to the above-described Application Example, the stirring member is formed of metal or resin or metal and resin.

According to the Application Example, the liquid container is provided with a stirring member having flexible portions covering the bottom surface of the containing portion. The stirring member is formed of metal or resin or metal and resin. The stirring member moves inside the liquid container when the liquid container is rocked and the flexible portion is deformed by the force received from the liquid and the containing portion. The convection of the liquid is promoted by the movement of the stirring member and the deformation of the flexible portion and, in a case where the dispersed particles are precipitating, the dispersion in the solvent is promoted.

Application Example 11

A liquid ejecting apparatus according to the Application Example is mounted with the liquid container according to the above-described Application Examples.

By using the liquid container according to the above-described Application Example as the liquid container for supplying liquid, it is possible to provide a more effective liquid ejecting apparatus with excellent characteristics as a liquid ejecting apparatus capable of ejecting a liquid in which dispersed particles are dispersed and mixed.

For example, the apparatus is ideal as an ink jet recording apparatus using ink in which dispersed particles such as pigments are uniformly dispersed and mixed.

Application Example 12

A kit, which is formed of the liquid container according to the Application Example and an information medium, stores information, which includes the stirring method of the liquid contained in the containing portion, in the information medium.

According to the Application Example, the liquid container is provided with a stirring member having flexible portions covering the bottom surface of the containing portion. In addition, information including the stirring method of the liquid is stored in the information medium.

Accordingly, the user can easily obtain information regarding the stirring member and the stirring method necessary for the stirring when using the liquid container in which the liquid in which the dispersed particles are dispersed is contained. As a result, by the user performing appropriate stirring, it is possible to reduce the problems of the generation of color unevenness, ink clogging, ejection defects, and the like.

Application Example 13

For the liquid container, the stirring method includes a liquid container rocking method, which is a method of maintaining a face of the liquid container to be horizontal, and reciprocating in the long side direction of the face of the liquid container as the longitudinal direction of the liquid container, or which is a method of moving both short sides of the face of the liquid container up and down alternately.

According to the Application Example, the liquid container is provided with a stirring member having flexible portions covering the bottom surface of the containing portion. For example, in a case where the density of the material configuring the stirring member including the flexible portion is higher than the density of the liquid, when the liquid container is left to stand, the stirring member including the flexible portion precipitates so as to cover the bottom surface of the containing portion. In addition, information including the rocking method of the liquid container as the stirring method of the liquid is stored in the information medium. The rocking method is a method of reciprocating in the longitudinal direction of the face of the liquid container, or a method of reciprocating in a seesaw shape in the longitudinal direction. The stirring member moves inside the liquid container when the liquid container is rocked and the flexible portion is deformed by the force received from the liquid and the containing portion. The convection of the liquid is promoted by the movement of the stirring member and the deformation of the flexible portion covering the bottom surface of the containing portion and, in a case where the dispersed particles are precipitating, the dispersion in the solvent is promoted. In particular, in a case where the liquid container is left to stand, since the dispersed particles are precipitated in the upper portion of the flexible portion covering the bottom surface of the containing portion, it is possible to more effectively promote dispersion by the direct raising up or the like of the dispersed particles using the movement of the stirring member and the deformation of the flexible portion.

Accordingly, the user can easily obtain information regarding the stirring member of the liquid and a useful rocking method for the stirring when using the liquid container in which the liquid in which the dispersed particles are dispersed is contained. As a result, by the user performing appropriate stirring, it is possible to reduce the problems of the generation of color unevenness, ink clogging, ejection defects, and the like.

BRIEF DESCRIPTION OF THE DRAWINGS

The invention will be described with reference to the accompanying drawings, wherein like numbers reference like elements.

DESCRIPTION OF EXEMPLARY EMBODIMENTS

Hereinafter, specific embodiments of the invention will be described with reference to the drawings. The following is one embodiment of the invention; however, the invention is not limited thereto. Here, in each of the following diagrams, for convenience of description, there are cases where the scale used in the description is different from that actually used. In addition, "rectangular parallelopiped" in the invention signifies a substantially parallelopiped shape rather than a cube shape, and a part of the sides in the configuration may be drawn with a curve or the like, or irregularities or the like may be formed at a part of the surface. In addition, "rectangle" in the invention signifies being substantially a rectangle rather than a square shape, and a part of the sides in the configuration may be drawn with a curve or the like.

Embodiment 1

First, description will be given of the liquid container according to Embodiment 1.

Figure 1:
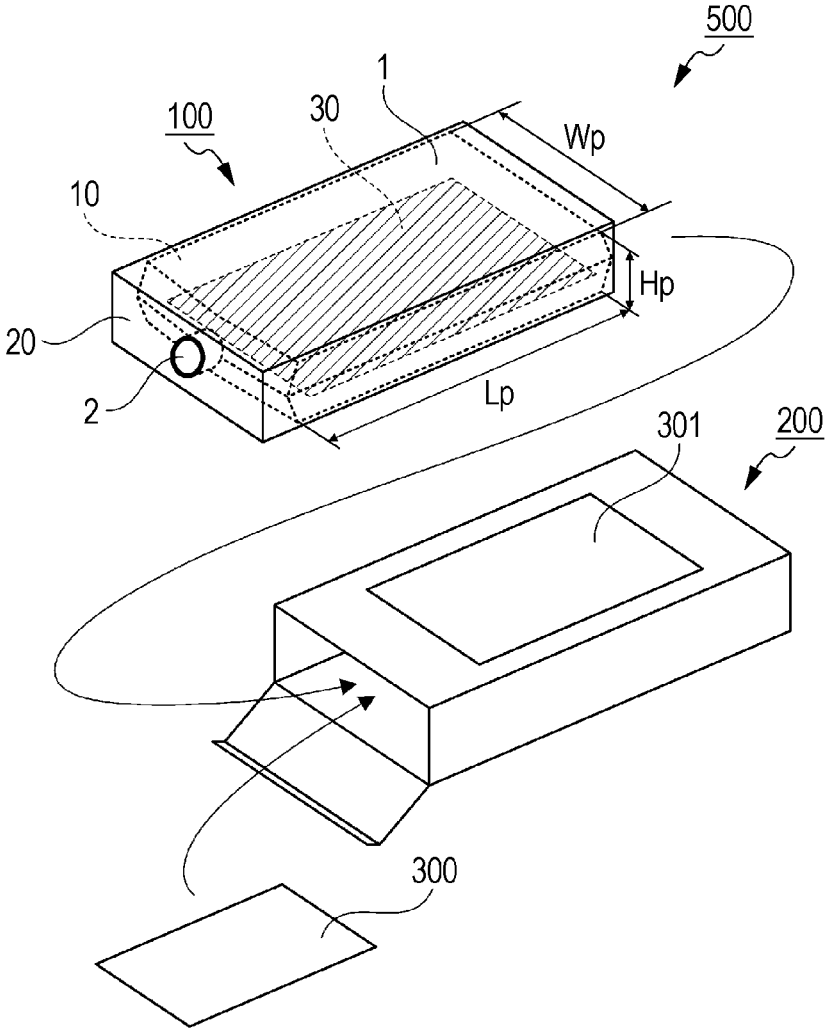
FIG. 1 is a perspective view showing an ink cartridge kit including an ink cartridge as a liquid container according to Embodiment 1.

FIG. 1 is a perspective view showing an ink cartridge kit 500 including an ink cartridge 100 as the liquid container according to Embodiment 1. The ink cartridge kit 500 is configured by the ink cartridge 100, a packaging box 200, and an instruction manual 300 as an information medium.

The ink cartridge 100 is an example of a liquid container containing ink to be supplied to the ink jet recording method as a liquid ejecting apparatus, and is used by mounting on the ink jet recording apparatus. The ink cartridge 100 is configured by an ink pack 10 as a containing portion, a cartridge housing 20, a stirring member 30, and the like.

The ink pack 10 is a bag formed of a resin film or the like and contains an ink 1 in the inner portion thereof. The ink 1 contained in the ink pack 10 is supplied to the ink jet recording apparatus through an ink supply port 2 communicating with the ink pack 10.

The cartridge housing 20 is a resin case or the like with a flat, substantially rectangular parallelopiped shape, and contains the ink pack 10 in the inner portion thereof. In a case where the ink 1 is filled in the ink pack 10, the flat upper surface and bottom surface of the ink pack 10 have a shape following the inner walls of the cartridge housing 20.

The ink 1 is an ink for recording which includes dispersed particles at a predetermined concentration, and is configured according to the purpose thereof by various dispersed particles and various additives and solvents. In the material of the dispersed particles, for example, as a white pigment, metal oxide particles such as titanium dioxide, zinc oxide, silica, alumina, magnesium oxide, and zirconium oxide, or resin particles having a hollow structure are used. In addition, for example, as glitter pigment, metal particles such as aluminum, silver, gold, platinum, nickel, chromium, tin, zinc, indium, titanium, and copper, or pigments having pearlescence or interference gloss such as mica-coated titanium dioxide, argentine, and bismuth acid chloride are used.

In general, in a case of the above-described dispersed particles, since the density of the dispersed particles is greater than the density of the solvent, in a case of being left to stand for a long period, there is a tendency for the dispersed particles to precipitate. Since the precipitation of the dispersed particles leads to a decrease in recording quality, such as color unevenness or ink clogging in the recording apparatus, ejection defects or the like, it is necessary to effectively stir the ink 1 prior to use.

The stirring member 30 is a stirring member for effectively stirring the ink 1 contained in the inner portion by rocking the ink cartridge 100, and is contained in the ink pack 10. The stirring member 30 is preferably a resin plate having a flat shape and has flexible portions 40 to be described later. In a case where the rectangular upper surface or the rectangular bottom surface configuring the flat surface of the ink cartridge 100 is left to stand so as to become substantially parallel to the horizontal face, the flexible portions 40 are positioned so as to cover the bottom surface of the ink pack 10.

Here, the material used in the stirring member 30 is not limited to resin, and may be rubber or metal. Examples of the resins include polyvinyl chloride, polyethylene terephthalate, polycarbonate, polystyrene, polyurethane, polyethylene, polypropylene, nylon, polytetrafluoroethylene, polyacryl, and the like. Examples of the rubbers include acrylonitrile-butadiene rubber (NBR), natural rubber (NR), butadiene rubber (BR), styrene-butadiene copolymer rubber (SBR), polyisoprene rubber (IR), butyl rubber (IIR), chlorobutyl rubber (CL-IIR), bromo butyl rubber (Br-IIR), chloroprene rubber, ethylene-propylene copolymer rubber, styrene-isoprene copolymer rubber, styrene-isoprene-butadiene copolymer rubber, isoprene-butadiene copolymer rubber, chlorosulfonated polyethylene, and the like.

Figure 2A:
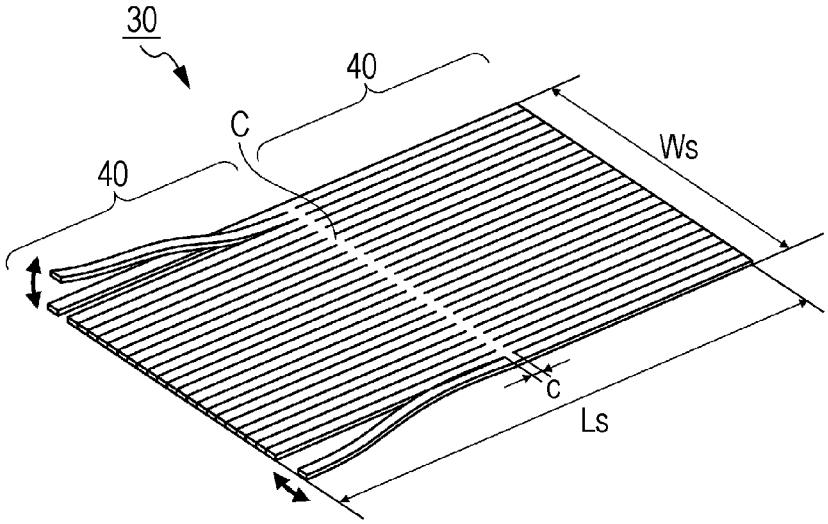
FIGS. 2A and 2B are perspective views of a stirring member and flexible portions of the stirring member according to Embodiment 1.
Figure 2B:
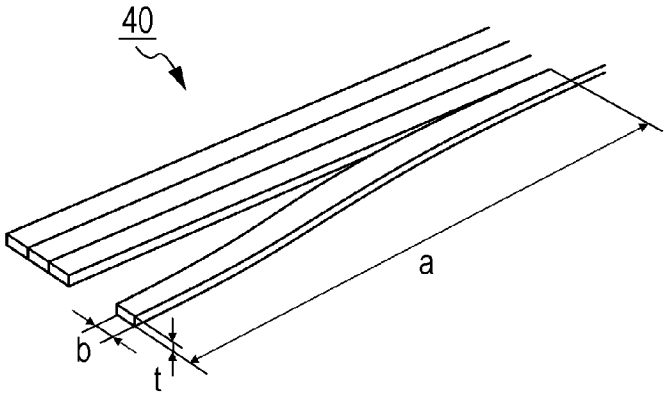

FIG. 2A is a perspective view of the stirring member 30, and FIG. 2B is a perspective view of the flexible portions 40.

Next, with reference to these drawings, detailed description will be given of the stirring member 30 and the flexible portions 40.

The stirring member 30 is formed of a resin flat plate with a length Ls, a width Ws, and a thickness t, and has the flexible portions 40. The flexible portions 40 are formed as a part of the stirring member 30 with increased flexibility by adding slits with a fine, long shape to the stirring member 30. Specifically, according to the slits of the length a along the long side direction from the portions of both ends of the short sides of the stirring member 30, the flexible portions 40 are formed such that a plurality of lengths of width b are lined up. At this time, from the viewpoint of stirring efficiency, the forming is preferably such that length a>width b≥thickness t. In addition, for the same reason, the length a of the slit is Ls<2a, and it is preferable that a flat plate central portion part C of the stirring member 30 in which the remaining width c=Ls−2a join together the plurality of long shaped flexible portions 40.

The density of the resin flat plate configuring the stirring member 30 (including the flexible portions 40) is preferably greater than the density of the solvent.

In addition, the stirring member 30 has a necessary and sufficient size (length Ls×width Ws) with respect to the breadth (length Lp×width Wp×height Hp) of the inner portion of the ink pack 10 shown in FIG. 1A. Specifically, it is preferable that the area when the stirring member 30 is seen in planar view be configured so as to be 50% or more of the area of the bottom surface of the ink pack 10 in terms of increasing the stirring efficiency.

In addition, it is even more preferable that a configuration be adopted in which, when the area of the stirring member 30 is set to As (=Ls×Ws), and the total of the areas of the bottom surface and the side surface of the ink pack 10 is set to Ap (=Lp×Wp+2 (Lp×Hp+Wp×Hp), As>0.5Ap.

In addition, the area when the flexible portions 40 are seen in planar view becomes 70% or more of the area when the stirring member 30 is seen in planar view.

In other words, a configuration is adopted in which, when the area when the flexible portions 40 are seen in planar view is set to Am (=2a×Ws), Am≥0.7 As.

In addition, the stirring member 30 is contained in the ink pack 10 such that the long side direction (longitudinal direction of the rectangle) of the stirring member 30 and the long side direction of the bottom surface of the ink pack 10 are substantially the same direction. Since the stirring member 30 rotates along with the rocking of the ink cartridge 100 and the containing direction is set not to change, it is preferable that a configuration be adopted in which the length of the diagonal line of the stirring member 30 becomes greater than the inner portion width Wp of the ink pack 10. Furthermore, from the viewpoints of suppressing the rotation of the ink pack of the stirring member 30 and preventing loss of stirring efficiency, it is preferable to have a relationship in which width Ws>Height Hp.

As in an Example which is an example of a suitable example to be described later, by using a member having flexibility and of which the thickness t is sufficiently thin (t≤0.3 mm), setting the length a to the necessary and sufficient length described above, and setting the width b to a necessary and sufficient fineness (b≤10 mm), it is possible to adopt a configuration in which individual long shaped portions of the flexible portions 40 are sufficiently moved by receiving the movement of the liquid as shown by the arrow in FIG. 2A.

The packaging box 200 is a packaging box containing the ink cartridge 100, the instruction manual 300, and the like, and is provided with a descriptive information storing portion (label 301) relating to the ink cartridge 100 on the outer surface. In the instruction manual 300 and the label 301, the stirring method of the ink 1 contained in the ink cartridge 100 and the storage method of the ink cartridge 100 in a case where the ink cartridge 100 is detached from the ink jet recording apparatus are stored.

Here, the storing of the stirring method and the storage method is not limited to the instruction manual 300 or the label 301, and it is possible to use various media therefor. For example, text information may be recorded as electronic information on a CD (Compact Disk), a DVD (Digital Versatile Disc), a flash memory, or the like. Alternatively, rather than storing the specific stirring method or storage method as text information, a form may be taken which stores a reference information URL (Uniform Resource Locator) which can access a web page in which the information regarding the stirring method and the storage method is stored, and the information regarding the stirring method and the storage method is referenced through a network.

The stirring may take the form of various methods according to the ink components, the form of the ink cartridge, the specifications of the recording apparatus, or the like. Specifically, there is a method of shaking (rocking) the ink cartridge, a method of repeatedly inverting and leaving to stand, a method of applying vibration, and the like.

These methods are capable of using a stirring mechanism built into the recording apparatus or a stirring mechanism separate from the recording apparatus; however, in the instruction manual 300 and the label 301, there is stored a method of rocking the ink cartridge 100 which assumes that the user performs the operation manually. The information showing the rocking method includes at least one of the rocking direction, the rocking width, the rocking speed, and the number of times of rocking.

The rocking direction is a direction for moving and shaking the ink cartridge 100, and describes an approximate direction with respect to the orientation of the ink cartridge 100 illustrated in the drawings and the like.

The rocking width is the amplitude of the moving and shaking of the ink cartridge 100, and describes an approximate width, or a method of imaging the width.

The rocking speed is the speed of the moving and shaking of the ink cartridge 100, and describes the number of times per unit time of moving and shaking with the rocking width, or a method of imaging the speed.

The number of times of rocking is the number of times of moving and shaking the ink cartridge 100, and describes an approximate number of times, or the time for which the rocking continues.

Figure 3A:
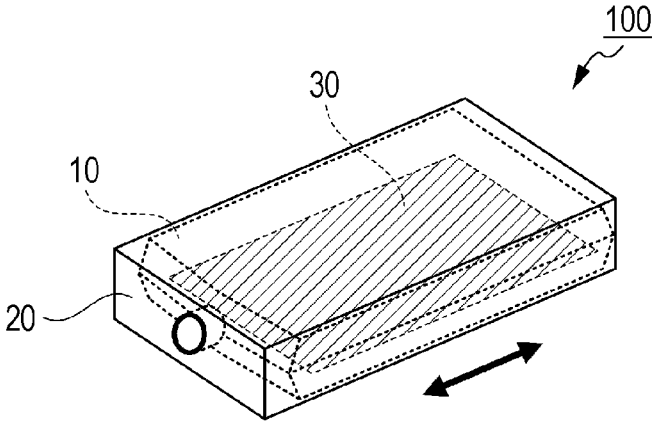
FIGS. 3A and 3B are explanatory diagrams showing a rocking direction of the ink cartridge.
Figure 3B:
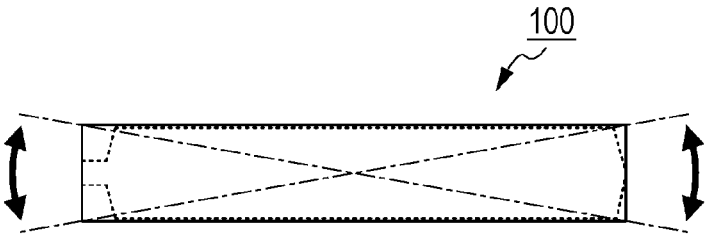

FIGS. 3A and 3B are explanatory diagrams showing the direction of rocking the ink cartridge 100 for the stirring.

In the present embodiment, a method of counter-moving in the longitudinal direction of a face of the ink cartridge 100 as shown in FIG. 3A is effective, and a method of reciprocal moving in the longitudinal direction of the rectangular upper surface or the rectangular bottom surface configuring the flat face is particularly effective. In other words, by rocking the ink cartridge 100 in a direction in which the individual flexible portions 40 of the stirring member 30 contained in the inner portion extend, the flexible portions 40 are more effectively moved by the convection of the ink 1.

Here, the rocking method is not limited to that described above, for example, as shown in FIG. 3B, the method may be a method of alternately raising and lowering the short side of the rectangle of the ink cartridge 100, that is, a method of moving and shaking in a seesaw manner. The face of the rectangle is preferably configured as a flat face.

In addition, the storage method of the ink cartridge 100 in a case where the ink cartridge 100 is detached from the ink jet recording apparatus desirably places the ink cartridge 100 such that the bottom surface (flat face) of the ink cartridge 100 becomes substantially parallel to the horizontal plane.

Below, there is shown an example specifically describing information regarding a stirring method and a storage method provided in the ink cartridge kit 500. The instruction manual 300 and the label 301 respectively describe the following content.

Example of Document with Description

"In the case of replacement with a new ink cartridge, prior to the replacement, please stir the ink following the steps below.

Please take out the new ink cartridge from the packaging box and perform stirring before opening.

First, please hold the ink cartridge as shown in the drawing (drawing omitted) and shake well by shaking your wrist.

At this time, please take care that the ink cartridge does not hit the things around you by shaking in too violent a manner.

Regarding the standard for stirring time, sufficient stirring will be completed by shaking approximately twice per second and continuing for approximately one minute.

In addition, also in cases where the ink cartridge has not been used for a while, prior to use, please stir the ink following the steps below.

Please take out the set ink cartridge from the apparatus, seal the opening portion as shown in the drawing (drawing omitted), hold in one hand and shake well by shaking your wrist.

At this time, please take care that the ink cartridge does not hit the things around you by shaking in too violent a manner.

Regarding the standard for stirring time, sufficient stirring will be completed by shaking approximately twice per second and continuing for approximately one minute.

In addition, for the storage before the new ink cartridge is used or the storage in a case where the ink cartridge is detached from the apparatus, please store the ink cartridge such that the bottom surface of the ink cartridge is on the bottom as shown in the drawing (drawing omitted)."

As described above, using the ink cartridge 100 according to the present embodiment, it is possible to obtain the following effects.

The ink cartridge 100 is provided with the stirring member 30 having flexible portions 40 covering the bottom surface of the ink pack 10. The stirring member 30 moves in the inner portion of the ink pack 10 when the ink cartridge 100 is rocked and the flexible portions 40 are deformed by the force received from the ink 1 and the ink pack 10. The convection of the ink 1 is promoted by the movement of the stirring member 30 and the deformation of the flexible portions 40 and, in a case where the dispersed particles are precipitating, the dispersion in the solvent is promoted.

Accordingly, according to the liquid container according to the present embodiment, it is possible to provide a liquid container capable of more effectively stirring the dispersed particles by performing the rocking.

In addition, the density of the configuration of the stirring member 30 (and the flexible portions 40) is preferably greater than the density of the solvent. In this manner, in a case where the ink cartridge 100 is left to stand, the stirring member 30 sinks so as to cover the bottom surface thereof. By the sinking speed of the stirring member 30 being fast in comparison with the precipitation speed of the dispersed particles, many of the dispersed particles being dispersed are precipitated so as to be deposited on the stirring member 30. More effective dispersion in the solvent is promoted for the dispersed particles, which are precipitated so as to be deposited on the stirring member 30, by the movement of the stirring member 30 and, in particular, for the dispersed particles, which are precipitated so as to be deposited on the flexible portions 40, by the deformation of the flexible portions 40, thereby raising the dispersed particles up.

In addition, when the stirring member 30 has a flat plate shape, in a case where the ink cartridge 100 is left to stand, the dispersed particles dispersed in the upper portion of the stirring member 30 are precipitated so as to be deposited on the stirring member 30. The convection of the ink 1 is promoted by the movement of the flat plate shaped stirring member 30 and the deformation of the flexible portions 40 and, in a case where the dispersed particles are precipitating, the dispersion in the solvent is promoted. In particular, preferably, the more effective dispersion in the solvent of dispersed particles, which are precipitated so as to be deposited on the stirring member 30, is promoted by the movement of the stirring member 30 and the deformation of the flexible portions 40.

In addition, when the area of the bottom surface of the ink pack 10 covered by the stirring member 30 is 50% or more of the area of the bottom surface of the ink pack 10 in planar view (seen from above), it is possible to promote the dispersion of the dispersed particles across a wider region of the dispersed particles precipitated on the bottom surface portion of the ink pack 10. In other words, for example, in a case where a stirring ball or the like is used, the stirring ball needs to move around so as to scoop out dispersed particles precipitated over the entire bottom surface, and to do so, there was a need for a longer time and a greater number of stirrings, and for careful repetition of the rocking so as to make the stirring ball go across the entire bottom surface, in respect to which, it is possible to perform the stirring more easily and more reliably by using the stirring member 30. Here, "cover" in when covered in planar view (seen from above) also includes the meaning of without direct contact.

In addition, if the total of the areas of the bottom surface and the side surface of the ink pack 10 covered by the flexible portions 40 in planar view (seen from above) is 70% or more of the total areas of the bottom surface and the side surface of the ink pack 10 covered by the stirring member 30, the region in which the dispersion of the dispersed particles is promoted by the deformation of the flexible portions 40 is widened and it is possible to promote the more effective dispersion of the dispersed particles across a wider region. Here, "cover" in when covered in planar view (seen from above) also includes the meaning of without direct contact.

In addition, when the width b of the flexible portions 40 is width $b \leq 10$ mm, since the flexible portions 40 are more easily deformed by receiving the force from the ink 1 and the ink pack 10, and the dispersed particles are more effectively dispersed by promoting the convection of the ink 1, it is preferable.

In addition, when the thickness t of the flexible portions 40 is thickness $t \leq 0.3$ mm, since the flexible portions 40 are more easily deformed by receiving the force from the ink 1 and the ink pack 10, and the dispersed particles are more effectively dispersed by promoting the convection of the liquid, it is preferable.

In addition, since it is possible to further reduce the volume that the stirring member 30 occupies in the capacity of the ink cartridge 100 (ink pack 10), it is possible to provide a stirring member capable of effectively performing stirring without greatly decreasing the filling rate of the ink 1.

Embodiment 2

Next, description will be given of a liquid container according to Embodiment 2. Here, in the description, the same reference numerals will be used for the same constituent parts as Embodiment 1, and repetitive description thereof will be omitted.

Embodiment 2 is characterized in that a plurality of containing portions are contained in the inner portion of the liquid container.

Figure 4A:
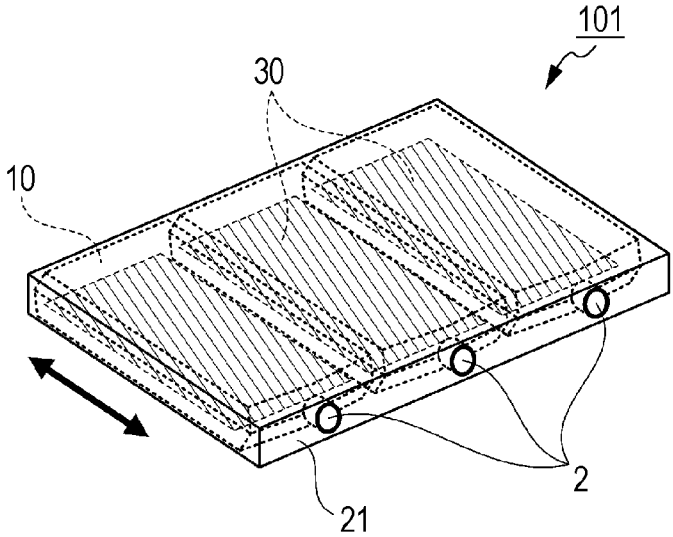
FIGS. 4A and 4B are perspective views showing an ink cartridge as a liquid container according to Embodiment 2.
Figure 4B:
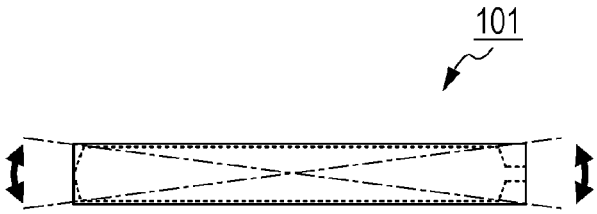

FIGS. 4A and 4B are perspective views showing an ink cartridge 101 as a liquid container according to Embodiment 2.

The ink cartridge 101 is configured by three ink packs 10 as containing portions, a cartridge housing 21, stirring members 30 contained in the respective ink packs 10, and the like.

The cartridge housing 21 is a resin case or the like with a flat, substantially rectangular parallelopiped shape, and contains the three ink packs 10 in the inner portion thereof.

The three ink packs 10 contain inks 1 having respectively different specifications in the inner portions thereof and contain stirring members 30. The ink 1 is supplied to the ink jet recording apparatus through the ink supply ports 2 communicating with the respective ink packs 10. The ink supply ports 2 are arranged on the same side of the cartridge housing 21.

In a case where the ink 1 is filled in the ink pack 10, the flat upper surface and bottom surface of the ink pack 10 have a shape following the inner walls of the cartridge housing 21.

Here, in the present embodiment, three ink packs 10 are contained in the inner portion of the ink cartridge 101; however, without being limited to this number, for example, only the number of the specifications of the ink 1 used in the ink jet recording apparatus may be contained in the same ink cartridge 101.

In the case of the above configuration, depending on the number of ink packs 10 arranged in a line, there are cases where the longitudinal direction of the ink cartridge 101 having the substantially rectangular parallelopiped shape and the longitudinal direction of the stirring members 30 are not the same direction. In such a case, a method of reciprocally moving in a direction intersecting the longitudinal direction of the rectangular upper surface or the rectangular bottom surface configuring the flat face of the ink cartridge 101 is effective. In other words, by rocking in a direction in which the individual flexible portions 40 of the stirring member 30 contained in the inner portion extend, the flexible portions 40 are more effectively moved by the convection of the ink 1.

Accordingly, the information regarding the stirring method provided in the ink cartridge kit 500 is described in the instruction manual 300 and the label 301 respectively as a method of reciprocal moving in a short side direction of the rectangular upper surface or the rectangular bottom surface configuring the flat face of the ink cartridge 101, or a method of alternately raising and lowering the long side of the rectangular upper surface or the rectangular bottom surface configuring the flat face of the ink cartridge 101.

As described above, even in the liquid container according to the present embodiment, since the behavior of the stirring members 30 in the inner portions of the ink packs 10 is the same as in Embodiment 1, it is possible to obtain the same effects as in Embodiment 1.

Embodiment 3

Next, description will be given of a liquid container according to Embodiment 3. Here, in the description, the same reference numerals will be used for the same constituent parts as Embodiment 1, and repetitive description thereof will be omitted.

Embodiment 3 is characterized in that a weight is further provided in the stirring members 30.

Figure 5:
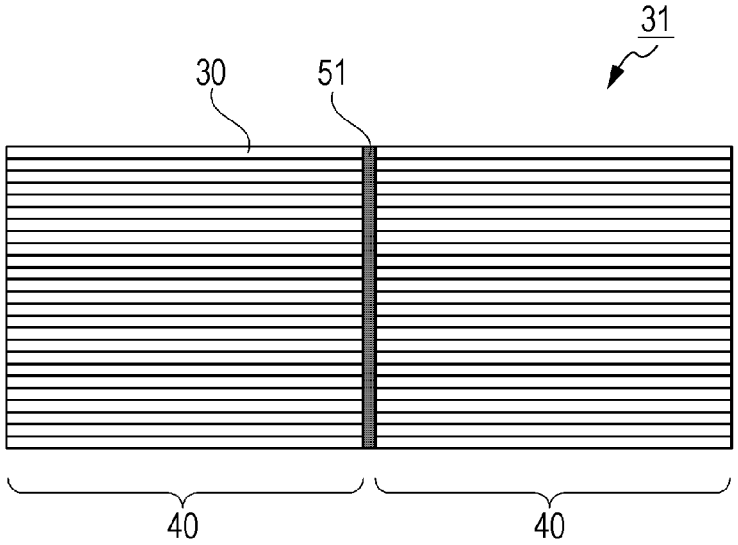
FIG. 5 is a planar view showing a stirring member according to Embodiment 3.

FIG. 5 is a planar view showing a stirring member 31 according to Embodiment 3.

In Embodiment 1, the flexible portions 40 were formed of the same material continuing as a part of the stirring member 30; however, the stirring members 31 are configured with the addition of a weight portion 51 formed of a material different to the stirring member 30.

The weight 51 is a metal plate with a density greater than the density of the stirring member 30, and is attached to the flat central portion part C (FIG. 2A) of the stirring member 30.

Here, the weight portion 51 need not necessarily be a metal plate, and need only be a flat plate having a greater density than the stirring member 30. Examples of the metals include aluminum (2.7 g/cm$^3$), silver (10.5 g/cm$^3$), gold, platinum, nickel (8.9 g/cm$^3$), iron (7.86 g/cm$^3$), chromium, lead, tin, zinc (7.14 g/cm$^3$), indium, titanium (4.5 g/cm$^3$), copper (8.93 g/cm$^3$), and the like, and it is possible to use at least one type selected from the above individually, or from alloys or mixtures thereof.

In addition, the weight portion 51 need not necessarily be a flat plate, and need only have a configuration which can be mounted on the central portion part of the stirring member. For example, the weight portion may be a clip which is fixed by pinching the central portion part of the stirring member 30. In the case of the clip, the density is preferably 1 g/cm$^3$ or more, more preferably 2 g/cm$^3$ or more, and even more preferably 4 g/cm$^3$ or more. In addition, as the material of the clip, plastic or glass is preferable and metal is more preferable.

The stirring member 31 can be applied to the ink cartridges 100 and 101 instead of the stirring member 30.

According to the ink cartridges 100 and 101 in which the stirring member 31 of the present embodiment is applied, since the weight portion 51 with a density of 1 g/cm$^3$ is further provided in the stirring member 30, in a case where the ink cartridges 100 and 101 are rocked, the stirring member 30 moves more easily in the ink 1. As a result, the dispersed particles are more effectively dispersed by promoting the convection of the ink 1. In addition, since the weight portion 51 sinks easily, the stirring member 31 can better fall into position according to the bottom surface without remaining on the side surface of the ink pack 10.

Embodiment 4

Next, description will be given of a liquid ejecting apparatus according to Embodiment 4. Here, in the description, the same reference numerals will be used for the same configuration as the embodiments described above, and repetitive description thereof will be omitted.

Embodiment 4 is an ink jet recording apparatus (omitted from the drawings) as a recording apparatus provided with the ink cartridge kit 500.

The ink jet recording apparatus is provided with the ink cartridge kit 500 as a starter kit. Therefore, at the time of initial use, there is no need to prepare a separate ink cartridge 100. In addition, as described above, the ink cartridge kit 500 is provided with information regarding the stirring method of the ink cartridge 100 to be used. Accordingly, according to the ink jet recording apparatus of the present embodiment, the user is able to easily obtain information regarding the necessary stirring method at the time of use. As a result, it is possible to reduce the problems of the generation of color unevenness, ink clogging, ejection defects, and the like.

Next, description will be given of Examples evaluated with several specifications with regards to the respective stirring members, flexible portions, and stirring methods.

Figure 6A:
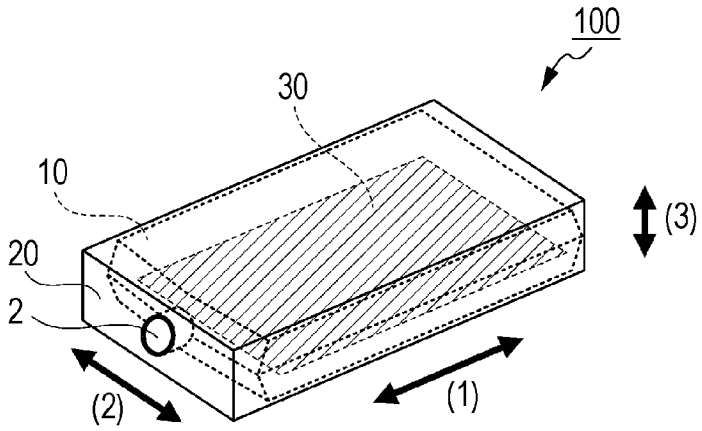
FIGS. 6A and 6B are explanatory diagrams showing a rocking direction of the ink cartridge.
Figure 6B:
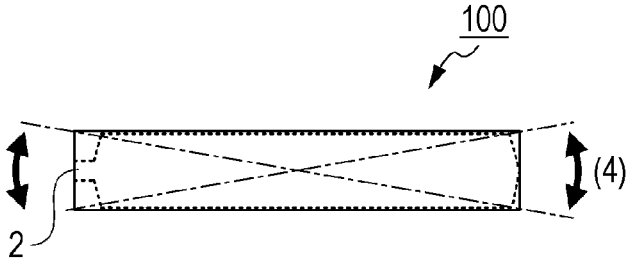

FIGS. 6A and 6B are a perspective view and a side surface view showing a rocking direction of the ink cartridge 100 in the evaluation. In FIG. 6A, the direction (1) in which the ink cartridge 100 is rocked indicates the longitudinal direction (long side direction) of the ink cartridge 100, the direction (2) indicates the short side direction, and the direction (3) indicates the thickness direction (height direction). In FIG. 6B, the direction (4) indicates the direction in which the short sides of both end of the ink cartridge 100 are alternately raised and lowered so as to be moved and shaken in a seesaw manner.

Description of the dimensions and reference numerals is given in FIGS. 2A and 2B and the rocking direction in FIGS. 6A and 6B.

First, the specifications common to the Examples will be explained below.

Stirring member (film): Lumirror S10 (Panac Corporation)

Ink cartridge 100: ICY58 (Seiko Epson Corporation)

Ink pack 10: bottom surface area approximately 19000 $mm^2$

Ink 1: titanium dioxide type white ink (below, ink composition)

Pigment (titanium dioxide, average particle diameter 200 nm) 10 mass % Dispersing agent (styrene-acrylic acid copolymer) 2 mass % 1,2-hexanediol 5 mass % Glycerin 10 mass % Triethanolamine 0.9 mass % BYK-348 (BYK-Chemie Japan Co., Ltd.) 0.5 mass % Ultrapure water remainder, total 100 mass %

The evaluation of the stirring effect was performed using the following method.

After adding 600 g of ink 1 to the ink cartridges 100 of Examples 1 to 8 to be described later and leaving the resultant to stand flat at room temperature for 30 days, evaluation of the stirring effect was performed by performing rocking 30 times with a shaking width of approximately 15 cm with three reciprocations per second in the designated direction in the respective Examples and measuring the change in the concentration.

As the measurement of the density, the ink 1 was taken out from the ink pack 10 at a flow rate of 80 ml per minute using a pump from the upper layer of the ink and the density of 5 ml of the ink 1 finally remaining was measured. As the measurement, the absorbance (500 nm) was measured using thousand-fold dilution in a spectrophotometer U-3300 (Hitachi High-Tech Fielding Corporation).

With reference to Table 1, description will be given of the Examples and Comparative Examples.

TABLE 1

| | Flexible Portions | | | Area | | Evaluation Result | |
|---|---|---|---|---|---|---|---|
| | Length a [mm] | Width b [mm] | Thickness t [μm] | Ratio [%] | Stirring Direction | Concentration ratio [+ %] | Determination |
| Example 1 | 86.5 | 1 | 100 | 61 | (1) | +30 | ○ |
| Example 2 | 86.5 | 2 | 100 | 61 | (1) | +28 | ○ |
| Example 3 | 86.5 | 4 | 100 | 61 | (1) | +42 | ○ |
| Example 4 | 86.5 | 2 | 50 | 61 | (1) | +30 | ○ |
| Example 5 | 86.5 | 2 | 188 | 61 | (1) | +35 | ○ |
| Example 6 | 100.0 | 2 | 100 | 87 | (1) | +26 | ○ |
| Example 7 | 35.5 | 2 | 100 | 61 | (1) | +61 | Δ |
| Example 8 | 86.5 | 2 | 100 | 61 | (4) | +8 | ○ |
| Example 10 | 86.5 | 2 | 100 | 61 | (2) | +112 | X |
| Example 11 | 86.5 | 2 | 100 | 61 | (3) | +125 | X |
| Comparative Example 1 | No flexible portion slits | | 100 | 61 | (1) | +159 | X |
| Comparative Example 2 | Stirring bar: SUS ball | | | | (1) | +105 | X |
| Comparative Example 3 | Stirring bar: None | | | | (1) | +122 | X |

Examples 1 to 3

The size of the film as a stirring member uses Ls=178 mm, Ws=76 mm, t=100 μm. The area ratio covered by the bottom surface and the side surface of the ink pack 10 is 61%. Evaluation was performed with the width b of the flexible portions set to 1 mm, 2 mm, and 4 mm as Examples 1, 2, and 3. The rocking direction was set to direction (1).

Examples 4 and 5

Evaluation was performed after changing the thickness of the film as the stirring member. As Examples 4 and 5, the thickness t of the film was evaluated at 50 μm and 188 μm. Otherwise, everything is the same as in Example 2.

Example 6

Example 6 increases the size of the stirring member, and the area ratio of the bottom surface and the side surface of the ink pack 10 was evaluated as 87%. In addition, the length a of the flexible portions was set to 100 mm. Otherwise, everything is the same as in Example 2.

Example 7

Example 7 set the direction in which the slits in the stirring member were added (extension direction of the flexible portions) to the short side direction of the stirring member. The length a of the flexible portions was set to 35.5 mm. Otherwise, everything is the same as in Example 2.

Example 8

Evaluation was performed after changing only the rocking direction with respect to Example 2. The rocking direction of Example 8 was set to direction (4).

Examples 10 and 11, Comparative Examples 1 to 3

In Example 10, evaluation was performed after changing only the rocking direction with respect to Example 2. The rocking direction of Example 10 was set to direction (2).

In Example 11, evaluation was performed after changing only the rocking direction with respect to Example 2. The rocking direction of Example 10 was set to direction (3).

Comparative Example 1 made a comparison with a stirring member which did not have flexible portions. In other words, evaluation was performed in a film state in which slits of the same size as Examples 1 to 3 were not added.

Comparative Example 2 made a comparison using a stirring bar as the stirring member. As the stirring bar, an SUS ball (steel ball, AS ONE Corporation, Product No. 1-9762-03, 7.9 g/cm$^3$, diameter 10 mm) was used.

Comparative Example 3 made a comparison using a method in which a stirring member was not used.

Using the above-described Examples and Comparative Examples, the density changes of the pigments were evaluated by stirring, and the effects of the stirring were determined. The determination was performed with the density ratio based on the pigment density calculated from the composition of the ink 1.

In other words, the evaluation was better when the recovery was performed closer to a uniform dispersion, and the evaluation was bad in the case of an evaluation of a case in which the density due to precipitation was still high.

Determination criteria: O (Good): 0 to less than +50%

Δ (somewhat insufficient): +50% or more to less than +100% x (insufficient): +100% or more

In addition, evaluation was performed of Examples provided with a clip as a weight in the stirring member. The evaluation results are shown in Table 2.

TABLE 2

| | Flexible Portions | | | Area | | Evaluation Result | |
|---|---|---|---|---|---|---|---|
| | Length a [mm] | Width b [mm] | Thickness t [μm] | Ratio [%] | Stirring Direction | Concentration ratio [+ %] | Determination |
| Example 9 | 86.5 | 1 | 100 | 61 | (1) | +46 | ○ |
| Comparative Example 4 | No flexible portion slits | | 100 | 61 | (1) | +221 | X |
| Comparative Example 5 | Stirring bar: SUS ball | | | | (1) | +245 | X |

Example 9

Since the stirring member is more difficult to move in the ink 1 when the density of the pigment is increased, in Example 9, evaluation was performed after raising the pigment density to 20%.

For Example 8, evaluation was performed after mounting the clip as a weight portion on the stirring member of Example 2.

Comparative Examples 4 and 5

Comparative Examples 4 and 5 are the same as Comparative Examples 1 and 2 except for the point that evaluation was performed after raising the pigment density to 20%.

The evaluation and determination were performed in the same manner as described above.

Here, the invention is not limited to the above-mentioned embodiments, and various modifications, improvements, and the like can be added to the above-mentioned embodiments.

Modification Examples are shown below. Here, the same reference numerals will be used for the same constituent parts as the above-mentioned embodiments, and repetitive description thereof will be omitted.

Modification Example 1

Figure 7A:
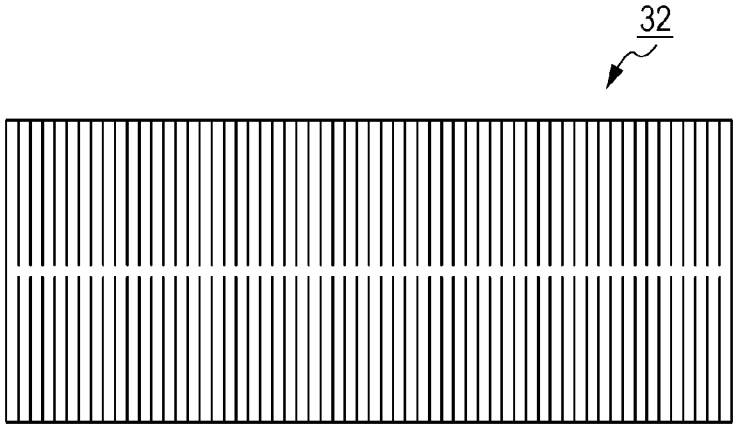
FIGS. 7A and 7B are planar diagrams of a stirring member according to Modification Example 1.
Figure 7B:
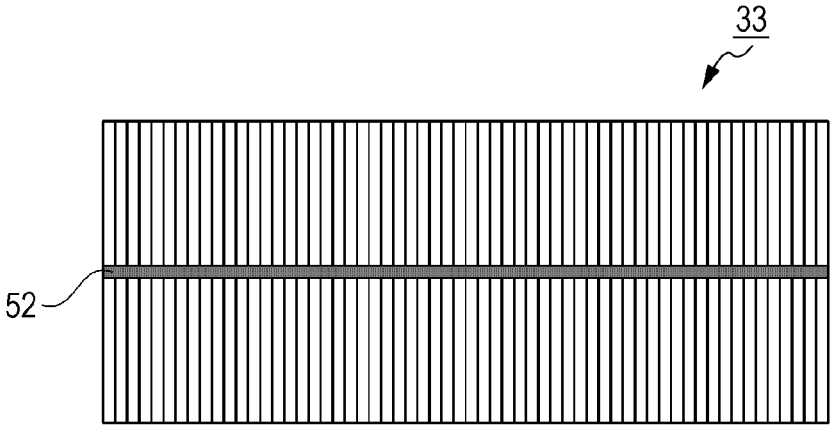

FIGS. 7A and 7B are planar views of stirring members 32 and 33 according to Modification Example 1.

In the above-mentioned embodiments, as shown in FIG. 2 and FIG. 5, description has been given of a favorable example of the flexible portions 40 which are formed by slits having a length a along the long side direction from the portions of both ends of the short sides of the stirring members 30 and 31 such that a plurality of lengths of width b are lined up and the length a>width b>thickness t; however, the flexible portions are not limited to such a configuration. For example, as shown in FIGS. 7A and 7B, a plurality of lengths may be formed so as to line up by slits along the short side direction from the portion of both ends of the long sides of the stirring members 30 and 31. A stirring member 33 is provided with a weight portion 52. The weight portion 52 is a metal plate having a density greater than the density of the stirring member 33, and is attached to the flat central portion part of the stirring member 33.

The stirring members 32 and 33 in the present Modification Example are also capable of obtaining the same effects as the above-described embodiments.

Modification Example 2

Figure 8A:
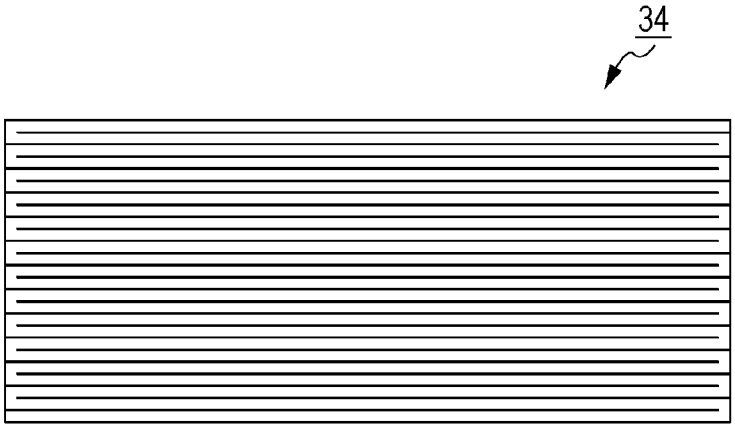
FIGS. 8A and 8B are planar diagrams of a stirring member according to Modification Example 2.
Figure 8B:
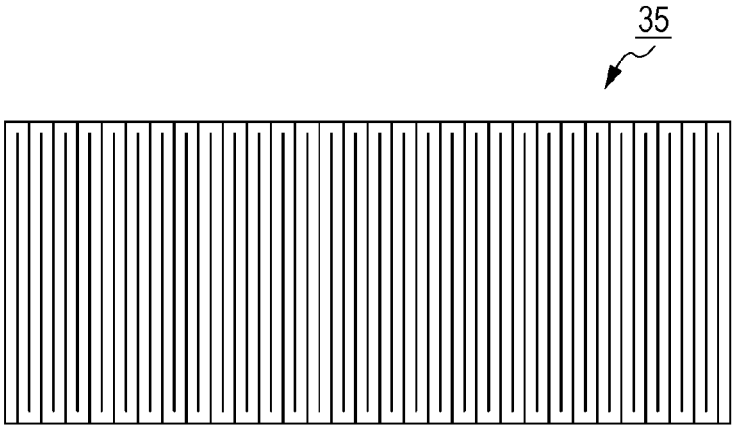

FIGS. 8A and 8B are planar views of the stirring members 34 and 35 according to Modification Example 2.

In the embodiments described above, as shown in FIG. 2 and FIG. 5, the flexible portions 40 are configured as a part of the stirring members 30 and 31; however, without being limited thereto, the entire body of the stirring member may be the flexible portions.

A stirring member 34 is an example where the entire body of the stirring member is set as the flexible portions by slits alternating along the long side direction from the short side portion of both ends of the stirring member 30.

In addition, a stirring member 35 is an example where the entire body of the stirring member is set as the flexible portions by slits alternating along the short side direction from the long side portion of both ends of the stirring member 30.

The stirring members 34 and 35 in the present Modification Example are also capable of obtaining the same effects as the above-described embodiments. In particular, since the area of the flexible portions is increased, it is possible to more effectively disperse the precipitated dispersed particles and it is possible to perform stirring effectively.

Modification Example 3

Figure 9A:
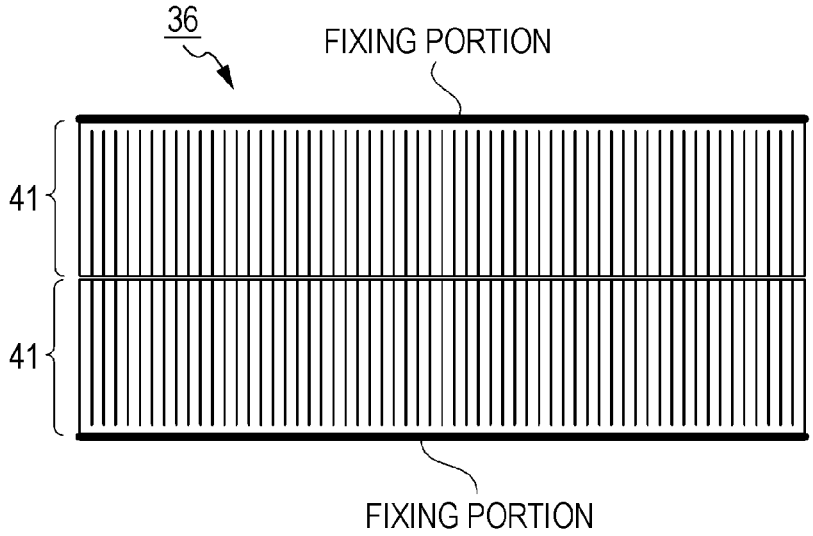
FIGS. 9A and 9B are planar diagrams of stirring members according to Modification Example 3.
Figure 9B:
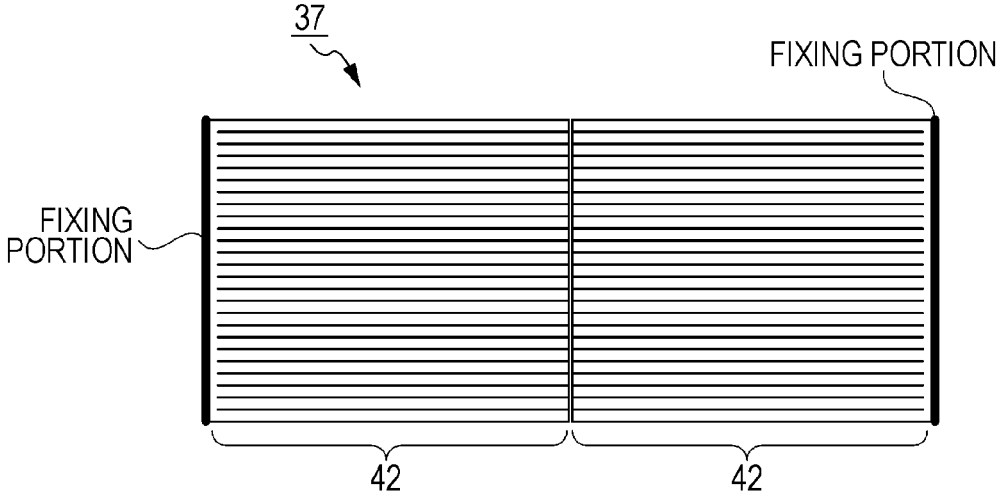

FIGS. 9A and 9B are planar diagrams of stirring members 36 and 37 according to Modification Example 3.

In the above-mentioned embodiments, description has been given in which the stirring members 30 and 31 are contained in the inner portion of the ink pack 10 and are able to move in the ink 1; however, a part of the stirring members 30 and 31 may be fixed to the inner wall of the ink pack 10.

A stirring member 36 is two resin plates having a rectangular flat shape, in which a first long side of the first resin plates is fixed to the inner wall side surface of the long side of the ink pack 10. A large number of slits are added from the other long side to the first side, which is fixed in the short side direction, thus forming the flexible portions 41. The other resin plate is fixed in the same manner to the inner wall side surface opposing the ink pack 10 so as to oppose the first resin plate. The respective flexible portions 41 of the two resin plates extend up to the central portion part of the ink pack 10.

The stirring member 37 is two resin plates having a rectangular flat shape and is the same as the stirring member 36 except for the point that the short sides of the respective resin plates and the inner wall side surfaces of the short sides of the ink pack 10 are fixed together.

The stirring members 36 and 37 are also capable of obtaining the same effects as the above-described embodiments. In particular, since the movement of the ink pack 10 is directly transmitted to the stirring members 36 and 37, the flexible portions 41 and 42 move more strongly, deform repeatedly, and bring about convection with respect to the precipitated dispersed particles, whereby it is possible to perform stirring more effectively.

Modification Example 4

Figure 10A:
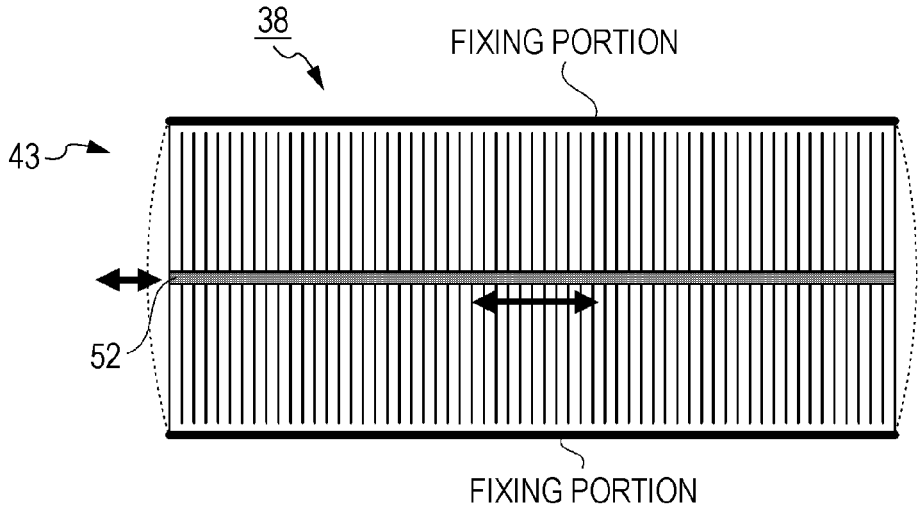
FIGS. 10A and 10B are planar diagrams of stirring members according to Modification Example 4.
Figure 10B:
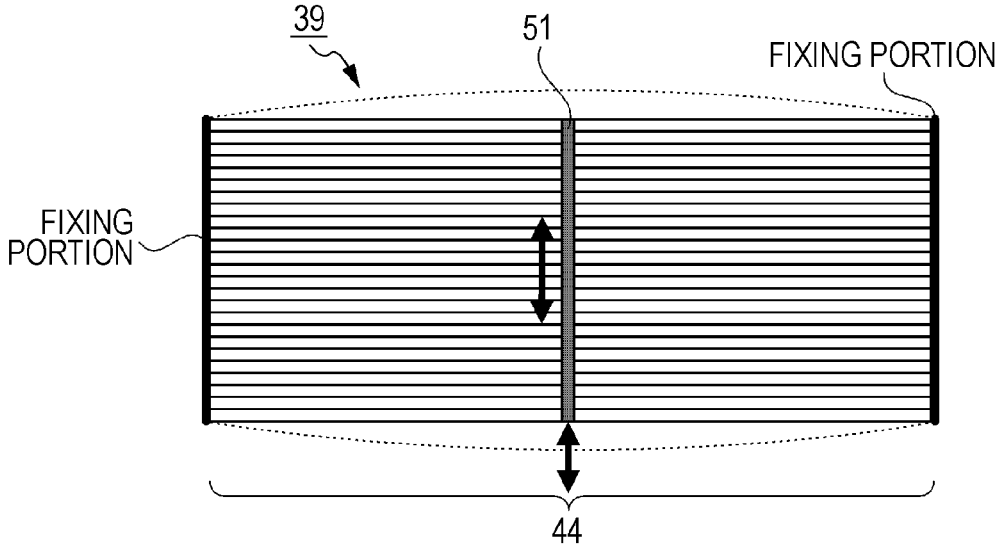

FIGS. 10A and 10B are planar diagrams of stirring members 38 and 39 according to Modification Example 4.

In the above-mentioned embodiments, the flexible portions had a free end; however, in the Modification Examples, since the free ends are linked by the weight portion, the flexible portions no longer possess the free ends. However, the flexible portions are capable of moving due to having a bend.

The stirring member 38 is configured such that the free ends facing the flexible portions 41 of the stirring member 36 (FIG. 9A) are linked by the weight portion 52. Alternatively, two long side portions of the stirring member 33 (FIG. 7B) are configured so as to be fixed to the inner wall of the ink pack 10. In addition, the length of the flexible portions 43 linked by the weight portion 52 is set to be longer than the distance of the inner wall side surface of the ink pack 10 to which the stirring member 38 is fixed. Therefore, the flexible portions 43 have a bend. Since the movement of the ink pack 10 is directly transmitted to the stirring member 38 and the weight portion 52 moves while possessing inertia, the movement of flexible portions 43 to which slits are added in the bend portion gives rise to convection more strongly in the liquid while twisting or the like is being generated. As a result, it is possible to more effectively perform stirring.

A stirring member 39 is the same as the stirring member 38 except for the point that a fixing portion and the weight portion are formed at the short side of the stirring member and the ink pack 10. The stirring member 39 is configured such that the free ends facing the flexible portions 42 of the stirring member 37 (FIG. 9B) are linked by the weight portion 51. Alternatively, two long side portions of the stirring member 31 (FIG. 5) are configured so as to be fixed to the inner wall of the ink pack 10. In addition, the length of the flexible portions 44 linked by the weight portion 51 is set to be greater than the distance of the inner wall side surface of the ink pack 10 to which the stirring member 39 is fixed. Therefore, the flexible portions 44 have a bend. In a case where the stirring member is fixed to another member, the entire surface of the stirring member may be formed as flexible portions.

Also in the case of the stirring member 39 according to the present Modification Example, it is possible to more effectively perform stirring in the same manner as the stirring member 38.

Modification Example 5

In Embodiment 4, the ink jet recording apparatus has been described as provided with the ink cartridge kit 500 as the starter kit; however, it is not always necessary to include the ink cartridge 100 and a configuration further provided only with information of the stirring method may be adopted. In other words, the ink jet recording apparatus may be configured to be provided with the instruction manual 300 or the like storing information regarding the necessary ink stirring method without being provided with the ink cartridge kit 500.

According to the ink jet recording apparatus according to the present Modification Example, the user is able to easily obtain information regarding the necessary stirring method at the time of use. As a result, it is possible to reduce the problems of the generation of color unevenness, ink clogging, ejection defects, and the like.

What is claimed is:

1. A liquid container comprising:

a containing portion containing a liquid including dispersed particles and a solvent in which the dispersed particles are dispersed, and a stirring member contained in the containing portion, wherein the stirring member includes a length, a width, and a base portion, and the stirring member includes a plurality of flexible portions each separated by slits formed in the flexible portions that extend in a length direction from the base portion toward edges of the stirring member; and the flexible portions cover a bottom surface of the containing portion.

2. The liquid container according to claim 1, wherein a density of a member configuring the stirring member is greater than a density of the solvent.

3. The liquid container according to claim 2, further comprising a liquid ejecting apparatus in communication with the containing portion.

4. The liquid container according to claim 1, wherein the stirring member has a flat plate shape.

5. The liquid container according to claim 4, further comprising a liquid ejecting apparatus in communication with the containing portion.

6. The liquid container according to claim 1, wherein an area when the stirring member is seen in planar view is 50% or more of an area of a bottom surface of the containing portion.

7. The liquid container according to claim 6, further comprising a liquid ejecting apparatus in communication with the containing portion.

8. The liquid container according to claim 1, wherein the stirring member has a plurality of the flexible portions.

9. The liquid container according to claim 8, wherein when a length of the flexible portions is set to a, a width is set to b, and a thickness is set to t, $t \leq 0.3$ mm.

10. The liquid container according to claim 9, further comprising a liquid ejecting apparatus in communication with the containing portion.

11. The liquid container according to claim 8, further comprising a liquid ejecting apparatus in communication with the containing portion.

12. The liquid container according to claim 1, wherein an area when the flexible portions are seen in planar view is 70% or more of the area when the stirring member is seen in planar view.

13. The liquid container according to claim 8, wherein when a length of the flexible portions is set to a, a width is set to b, and a thickness is set to t, $b \leq 10$ mm.

14. The liquid container according to claim 13, further comprising a liquid ejecting apparatus in communication with the containing portion.

15. The liquid container according to claim 12, further comprising a liquid ejecting apparatus in communication with the containing portion.

16. The liquid container according to claim 1, wherein the stirring member is further provided with a weight portion with a density of 1 $g/cm^3$ or more.

17. The liquid container according to claim 1, wherein the stirring member is formed of metal or resin or metal and resin.

18. The liquid container according to claim 1, further comprising a liquid ejecting apparatus in communication with the containing portion.

19. A kit comprising:

the liquid container according to claim 1; and an information medium, wherein the information medium includes information directed to steps to follow when conducting a stirring method of the liquid contained in the containing portion.

20. The kit according to claim 19, wherein the steps to follow when conducting a stirring method include one of shaking the liquid container and rocking the liquid container.

21. A liquid container, comprising:

a containing portion containing a liquid including dispersed particles and a solvent in which the dispersed particles are dispersed, and a stirring member contained in the containing portion, wherein the stirring member has flexible portions that cover a bottom surface of the containing portion;

a material of the stirring member is a resin of rubber; and wherein a length of the flexible portions is set to t, where t is $\leq 0.3$ mm.

22. A liquid container, comprising:

a containing portion containing a liquid including dispersed particles and a solvent in which the dispersed particles are dispersed, and a stirring member contained in the containing portion, wherein the stirring member has flexible portions that cover a bottom surface of the containing portion;

an area of the stirring member when viewed in plan is 50% or more of an area of the bottom surface of the containing portion; and when the liquid container is rocked, the flexible portions are operable to deform and raise the dispersed particles from the bottom surface of the containing portion.

* * * * *